US009506615B2

(12) United States Patent
Brendle

(10) Patent No.: US 9,506,615 B2
(45) Date of Patent: Nov. 29, 2016

(54) MOTOR VEHICLE HEADLAMP HAVING A MULTI-FUNCTION PROJECTION MODULE

(75) Inventor: Matthias Brendle, Tuebingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 163 days.

(21) Appl. No.: 14/002,999

(22) PCT Filed: Mar. 5, 2012

(86) PCT No.: PCT/EP2012/053725
§ 371 (c)(1),
(2), (4) Date: Sep. 30, 2013

(87) PCT Pub. No.: WO2012/119976
PCT Pub. Date: Sep. 13, 2012

(65) Prior Publication Data

US 2014/0016343 A1 Jan. 16, 2014

(30) Foreign Application Priority Data

Mar. 5, 2011 (DE) ..... 10 2011 013 211

(51) Int. Cl.
*F21V 7/00* (2006.01)
*F21S 8/10* (2006.01)

(52) U.S. Cl.
CPC ..... *F21S 48/1317* (2013.01); *F21S 48/1154* (2013.01); *F21S 48/1159* (2013.01); (Continued)

(58) Field of Classification Search
CPC ..... F21S 48/1154; F21S 48/1388; F21Y 2101/02
USPC ..... 362/518, 519, 538, 539, 520, 303, 305
See application file for complete search history.

(56) References Cited

U.S. PATENT DOCUMENTS 6,951,416 B2 * 10/2005 Sazuka ..... B60Q 1/04 362/507
7,524,094 B2 * 4/2009 Fukawa et al. ..... 362/514
(Continued)

FOREIGN PATENT DOCUMENTS

DE 102008015509 A1 10/2008
DE 102008036192 A1 2/2010
(Continued)

OTHER PUBLICATIONS

PCT Written Opinion PCT/EP2012/053725 dated May 16, 2012.
(Continued)

*Primary Examiner* — Peggy Neils
*Assistant Examiner* — Tsion Tumebo
(74) *Attorney, Agent, or Firm* — Howard & Howard Attorneys PLLC

(57) ABSTRACT

A motor vehicle headlamp (10) including a multi-function projection module (14), which is designed to convert light from a first light source (16) into a first light distribution (34) by means of a first primary lens system (18) in a first beam path bounded by an aperture edge (26), and to focus light from a second light source (20) into a beam waist (44) and convert the light into a second light distribution by means of a second primary lens system (22) in a second beam path. The second light distribution has a predetermined central point (56). The projection module includes a mirror (30), which is arranged in the second beam path between the beam waist (44) and the projection lens (28) in such a way that the mirror produces a virtual mirror image of the beam waist (44) at the focal point of the projection lens.

18 Claims, 6 Drawing Sheets

(52) U.S. Cl.
CPC ..... *F21S48/1225* (2013.01); *F21S 48/1241* (2013.01); *F21S 48/1329* (2013.01); *F21S 48/1388* (2013.01); *F21S 48/145* (2013.01); *F21S 48/1747* (2013.01)

(56) References Cited

U.S. PATENT DOCUMENTS

| | | | | |
|---|---|---|---|---|
| 7,690,818 | B2 * | 4/2010 | Takada | B60Q 1/12 362/297 |
| 2006/0120094 | A1 | 6/2006 | Tsukamoto et al. | |
| 2007/0086202 | A1 * | 4/2007 | Tsukamoto | F21S 48/1159 362/514 |
| 2007/0115679 | A1 * | 5/2007 | Alcelik | F21S 48/1388 362/518 |

FOREIGN PATENT DOCUMENTS

| | | | |
|---|---|---|---|
| DE | 102009049458 | A1 | 4/2011 |
| FR | 2944578 | A1 | 10/2010 |
| JP | 2006107875 | A | 4/2006 |

OTHER PUBLICATIONS

DE Examination Report DE 10 2011 013 211.2 dated Dec. 19, 2011.

* cited by examiner

MOTOR VEHICLE HEADLAMP HAVING A MULTI-FUNCTION PROJECTION MODULE

CROSS-REFERENCE TO RELATED APPLICATION

This is a "national stage" application of International Patent Application PCT/EP2012/053725 filed on Mar. 15, 2012, which, in turn, is based upon and claims priority to German Patent Application 10 2011 013 211.2 filed on Mar. 5, 2011.

BACKGROUND OF INVENTION

1. Field of Invention

The present invention relates to a motor vehicle headlamp having a multi-function projection module.

2. Description of the Related Art

A multi-function projection module involves a projection module by means of which it is possible to switch between different light functions. Examples for such light functions are low beam functions and high beam function.

A headlamp of this type is known from the JP 2006107875 and from the DE 10 2009 049 458 A1. This well-known headlamp has a bi-function projection module which comprises a first light source, a primary lens system, a second light source, a second primary lens system, an aperture having an aperture edge, a projection lens and a mirror. The headlamp converts light from the first light source into a first light distribution located in the front end of the projection module by means of the first primary lens system in a first beam-path bounded by the aperture edge. It has also been designed to focus light of the second light source into a beam waist by means of the second primary lens system in a second beam-path and to convert said light into a second light distribution located in the front end of the projection module, the second light distribution having a predetermined central point. The beam waist involves the strongest contraction of the high beam beam-path, i.e., the waist of the high beam bundle of rays.

Contrary to a reflection module in which a reflector collects the light of a light source and reflects it in a desired light distribution, a projection module is generally characterized in that it reproduces a light distribution generated inside the headlamp by means of a projection lens in a light distribution located in the front end of the headlamp. The light distribution generated inside the headlamp can comprise the light distribution in a light-emitting surface of a light source. However, in most cases such light distribution comprises a light distribution which is generated as an intermediate image in the focal plane by a primary lens system and an aperture.

For switching between a low beam distribution and the high beam distribution in most cases the position of the aperture is changed with regard to the light distribution generated in the headlamp. The position change takes place by means of a motorized drive of the aperture. At the same time, the different light distributions are generated by specifically blocking light beams which usually originate from a particular light source. The only light source is usually a gas discharge lamp.

Currently there are headlamps available that generate, for instance by means of projection lenses, from the light of several semi-conductor sources low beam or high beam distributions. Subsequently, such headlamps are described also as LED headlamps. Contrary to headlamps provided with gas discharge lamps as light sources, subsequently described also as Xenon headlamps, LED headlamps usually require not only several light sources, i.e., LED chips, but also a plurality of associated projection or reflection lenses. As a result, the total light distribution of LED headlamps is generally formed through superimposed light distributions of a plurality of light modules.

Efforts are now made to use the flexible apertures inserted in Xenon headlamps also in LED projection modules in order to be able to fulfill several low beam and/or high beam functions with a single light module. To this end, the low beam distribution is generated by blocking a portion of the high beam distribution. However, because of the low performance of the LED light modules, the required blockage of greater streams of light is particularly disadvantageous.

These disadvantages are avoided when the beam-paths for the respective light functions in the aperture plane of the projection module are divided so that the bundles of rays assigned to the light functions can be generated from different light sources that can be independently switched. As a result, it is possible to reproduce several light functions without using flexible apertures. At the same time, the different light functions are switched by merely switching the light sources on and off.

Depending on the physical effect, the division of the beam-path can be achieved by means of refraction, reflection or absorption. In this context, it is known from the DE 10 2007 052 696 A1 that a high beam and a low beam beam-path can be formed by means of internal total reflection on a boundary surface of a glass body, the edge of which generates a cut-off line in the low beam direction of the light. At the same time, the high beam bundles of rays are coupled into the same glass body as the low beam bundles of rays but impact the above-mentioned boundary surface at considerably steeper angles. As a result, they are not reflected but penetrate the surface and illuminate the area above the cut-off line and thus form a high beam distribution.

From the DE 10 2009 008 631 A1 it is known to guide a beam-path through a glass body having an integrally molded mirror surface where internal total reflection occurs. The beam-path is restricted by the fully reflecting surface in the focal plane of the projection lens in such a way that a strong cut-off line (HDG) is generated. Additional beam-paths are guided past the glass body in order to implement high beam functions.

When using mirror shutters according to the DE 10 2007 052 696 A1 or according to the DE 10 2009 008 631 A1 which operates in accordance with the total reflection method, it has to be ensured that the largest possible amount of beams coupling into the glass body leave the glass body in a controlled manner via the light emission surface on the front end. Moreover, the lowest amount of beams should escape on the side surfaces of the glass body because such beams could result in undesired stray light and/or glare.

Furthermore, it has to be ensured that only a small proportion of the beam-path to be guided past the glass body impacts the glass body and is there coupled into the glass body through refraction occurring perpendicular to the boundary surface at the impact point of the beam. These beams are lost for the desired light distribution because usually they no longer leave the glass body.

The US 2006/0120094 A1 and the DE 10 2008 036 192 A1 describe an alternative approach of using internal total reflections: here the beam-path is divided above and below the cut-off line by two reflecting surfaces and is projected onto the road through the lens of the projection module. This system can be designed also with absorbing surfaces which would, however, result in efficiency losses when compared with the model having reflecting surfaces.

These systems involve a difficulty with regard to producing a cut-off line in the desired light distribution. The difficulty consists of dividing the beam-paths of the different light functions in such a way that in the low beam function no undesired light is scattered beyond the cut-off line (no crosstalk), and in the high beam function no dark or colored line remains at the place of the low beam cut-off line.

In the subject matter of the above-mentioned JP 2006107875, these problems are avoided in that a high beam beam-path is guided through the projection lens past the aperture of the low beam beam-path.

However, since the associated high beam distribution would appear far above the horizon, a mirror is used in the subject matter of the JP 2006107875, the mirror being arranged in the optical path behind the projection lens, directing the high beam downward. However, from the aspect of design, such a mirror is often considered to be disturbing.

SUMMARY OF INVENTION AND ADVANTAGES

Against this background, the invention has the objective of providing a headlamp of the type mentioned above where the superimposition of the first light distribution and the second light distribution shows no dark line between the brightly illuminated areas of both light distributions and does not require a mirror to be arranged in the optical path behind the projection lens, visible from the outside.

The invention differs from the subject matter of the JP 2006107875 in that the mirror is arranged in the second beam path between the beam waist and the projection lens in such a way that it generates a virtual reflection of the beam waist which lies around a point that is assigned to the central point of the second light distribution through an image conveyed by the projection lens.

The image conveyed by the projection lens involves an image that would be produced without any obstructions in the beam path of the image. A point-shaped light source located at the place of the virtual reflection would be reproduced in the above-mentioned central point.

In real projection modules, this place of virtual reflection lies near the focal point of the projection lens or in said focal point. To produce cut-off line-free high beam distribution, the focal point of the projection lens, or the intersection point of the optical axis of the projection lens with its focal plane, would be a very suitable place for a light source by means of which high beam distribution is produced.

However, it is not possible to arrange a real light source at this point because the aperture edge required for generating low beam distribution has to be placed there.

The invention solves this problem in that a virtual image of the beam waist is generated by means of the mirror, and the virtual image is surrounding a point that is assigned to the central point of the second light distribution by means of the image conveyed by the projection lens. At the same time, the real second light source by means of which the high beam distribution is actually produced is located outside said point.

As opposed to multi-function projection modules in which high beam distribution is composed of a low beam distribution and a complimentary light distribution, a high beam distribution of the invention-based bi-function projection module is not composed of light distribution that are complimentary with regard to their light and dark areas. In such complimentary light distributions, the light area of the low beam distributions is located below a first cut-off line, and the light area of the complimentary light distribution is located above a further cut-off line. Both cut-off lines are produced by the same aperture. In complimentary light distributions generated in this way, the finite thickness of the aperture edge results in a particular distance between the cut-off lines which is perceived as a disturbing dark line in the composite high beam distribution. In the invention, this disturbing dark line is avoided right from the beginning.

Because of the fact that the mirror is located between the beam waist and the projection lens, it is not visible from the outside. Moreover, no installation space is required between a light emission side of the projection lens and light emission of the headlamp, as is the case with the JP 2006107875. The requirement to provide such installation space involves restrictions with regard to the scope of design when planning the headlamp. In the invention, such restrictions have been avoided.

Furthermore, it is of advantage that the invention uses a fixed aperture which, compared with adjustable apertures, does not require an adjustment drive or any other control system. Because of its rigid arrangement, it requires only comparatively low adjusting effort when assembling the projection module.

In one embodiment, when the headlight in the motor vehicle is used according to its intended purpose, the central point of the second light distribution corresponds to an intersection point of a horizontal line H=0 and a vertical line V=0 in front of the motor vehicle, as is always predetermined by lighting standards for motor vehicles. Because of this design, the second embodiment corresponds to a high beam distribution that is in accordance with the law.

In one embodiment, the mirror extends beyond a focal plane of the projection lens over a particular length in a space situated between the focal plane and the projection lens, which length is greater than half the focal plane of the projection lens. The mirror edges located inside the focal length in this defocused mirror arrangement are not sharply focused in the second light distribution. As a result, undesired cut-off lines in the second light distribution are avoided.

The mirror may be situated below the aperture edge of the aperture when used according to its intended purpose. When used in such a way, the aperture edge restricts the first downward beam path. By arranging the mirror below the aperture edge, it is avoided that the mirror protrudes into the first beam path and disturbs the generation of a desired first light distribution.

The aperture edge may be arranged at a distance from the projection lens that corresponds to a focal length of the projection lens. With this arrangement, the aperture edge is reproduced in the first light distribution in the desired manner as a sharp cut-off line. As a result, it is possible to design the first light distribution particularly as a low beam distribution in accordance with the law.

The rear surface of the mirror may include a light-diffusing coating and/or light-diffusing structures. These characteristics prevent disturbing reflexes. Such reflexes could occur in the headlamp when outside of the first and second beam path stray light impacts the projection lens after an undesired reflection on the rear surface of the mirror and is projected by the projection lens as a disturbing reflex to the front end of the headlamp.

As an alternative, a rear surface of the mirror may include a light-diffusing coating and/or scattering structures arranged to reflect incident light of the first light source on the projection lens in such a way that it is refracted by the projection lens as defined overhead illumination into a dark portion of the first light distribution. As a result, it is possible, for example, to improve the visibility of traffic signs.

The aperture may be implemented in the form of a mirror shutter which extends starting from the aperture edge into a space situated between the aperture edge and the first primary lens system, and which is arranged to reflect incident light on the projection lens in such a way that it is refracted by the projection lens in a light portion of the first light distribution. Due to these characteristics, the light that is hidden by the aperture from a first portion of the first beam-path in order to block in a desired manner a dark area of the first light distribution is not completely hidden from the first beam-path but is used for enhanced illumination of the lighter area of the first light distribution. As a result, high efficiency of the projection module is achieved, i.e., a high value of the quotient from the light of the first light source in the numerator supplied to the first light distribution and the entire light in the denominator emitted by the first light source.

The mirror may be designed in the form of a mirrored metallic surface and forms an integrally molded component. The processing steps required for producing the mirror surface, especially the coating of surfaces with metallic reflection layers, can be performed mutually. In addition, the adjustment effort for assembling the projection module is reduced, because during the adjustment of a component the mirror shutter of the first beam-path as well as the mirror of the second beam-path are being adjusted.

In addition, the mirror may be a boundary surface of a light conductor. This embodiment allows the light to be redirected inside the second beam-path by means of internal total reflection on the above-mentioned boundary surface. Contrary to reflections on metallic layers, which always involve low intensity losses, internal total reflections are characterized by an extremely small intensity loss, which contributes to high efficiency of the projection module.

In one embodiment, the light conductor together with the second primary lens system may be implemented as an integrally molded component. This embodiment is also characterized by a comparatively low adjustment effort, because during the adjustment of a component the primary lens system as well as the light conductor implementing the mirror for the second beam-path are being adjusted.

Further advantages can be derived from the following description and the attached figures. Naturally, the preceding and following characteristics can be used not only in the respectively described combination but also in different combinations or even alone without abandoning the scope of the present invention.

BRIEF DESCRIPTION OF THE DRAWINGS

Embodiments of the invention are represented in the drawings and are subsequently described in more detail. Corresponding reference numerals indicate corresponding elements or elements that have at least corresponding main functions. It is shown, respectively, in a schematic form.

DETAILED DESCRIPTION OF THE EMBODIMENTS OF THE INVENTION

Figure 1:
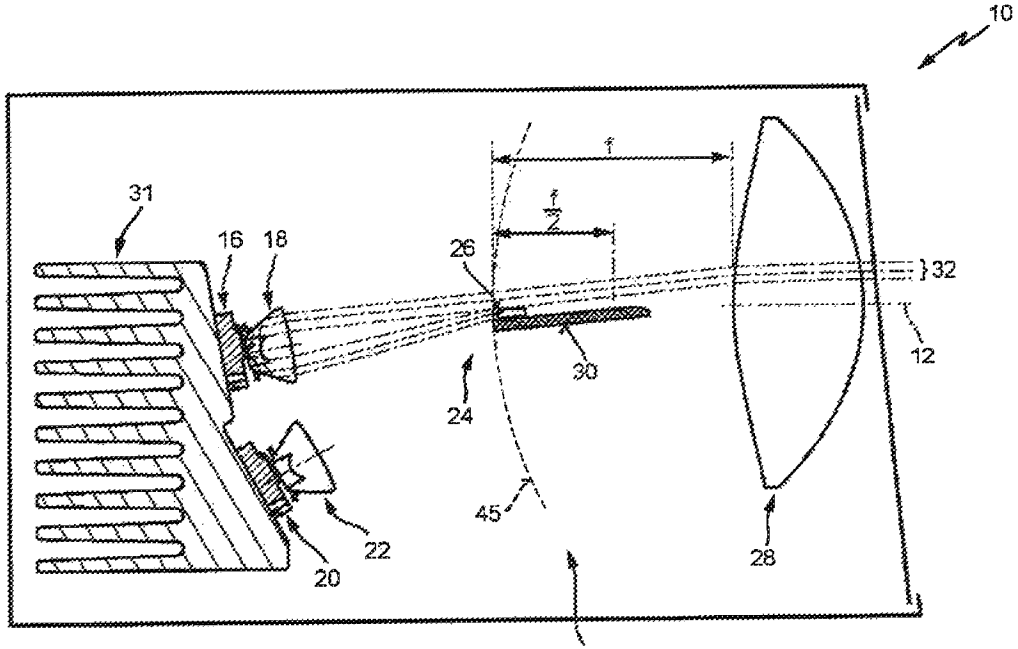
FIG. 1 illustrates one embodiment of the headlamp of the present invention.

In particular, FIG. 1 shows a motor vehicle headlamp 10 in a longitudinal cut along an optical axis 12 of the headlamp 10. The headlamp 10 includes a multi-function projection module 14 which has a first light source 16, a first primary lens system 18, a second light source 20, a second primary lens system 22, an aperture 24 with an aperture edge 26, a projection lens 28 and a mirror 30.

In one embodiment, the light sources 16, 20 are semiconductor light sources, such as light-emitting diodes or laser diodes which are mounted on a cooling element 31. The cooling element 31 absorbs the heat that is released when the semiconductor light sources are operated. The reference numerals 16 and 20 refer to semiconductor sources which are mounted on an associated circuit carrier. For motor vehicle headlamp applications, the semiconductor sources typically have light emission surfaces in the dimension of one square millimeter.

Because of the arrangement and dimensions of the above-mentioned elements, the multi-function projection module 14 is designed to transfer via the first primary lens system 18 located in a first beam path 32, which is restricted by the aperture edge 26, light of the first light source 16 in a first light distribution which is located in the front end of the projection module 14 and therefore in the front end of the headlamp 10. In the context of the present application, a beam path involves the sum of all possible paths, respectively, on which light of a light source is supplied to a light distribution in front of the multi-function projection module 14, or in front of the motor vehicle headlamp 10, which light is generated by said light source.

Figure 2:
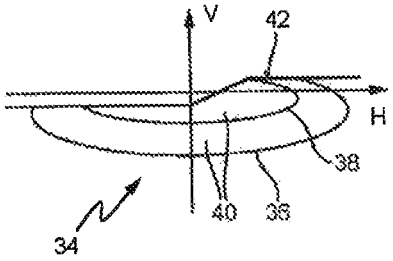
FIG. 2 is a light distribution as it is shown on a screen in the front end of the headlamp shown in FIG. 1.

FIG. 2 demonstrates such a first light distribution 34 that occurs on a standard measurements screen in the front end of the headlamp 10. At the same time, the screen is orthogonally adjusted to the optical axis 12 of the multi-function projection module 14 and is used for checking the illuminance achieved on the road in front of the motor vehicle when operating the headlamp. The screen extends toward a horizontal line H and a vertical line V, each of which are arranged orthogonally to one another and to the optical axis 12 of the projection module 14.

By means of curved isolux lines 36, 38, FIG. 2 shows a light distribution that results from operating the headlamp. Isolux are characterized in that the light intensity along one of these lines is constant. In light distributions generated by motor vehicle headlamps, the light intensity increases from the outside to the inside and thus across the line 38 toward the line 36.

In the subject matter of FIG. 1, the first light distribution 34 shown in FIG. 2 results from the first beam path 32 and includes in particular a light portion 40 which is located below the cut-off line 42. In the headlamp shown in FIG. 1, the first light distribution 34 is achieved when only the first light source 16 is switched on.

The cut-off line 42 is demonstrated as an image of the course of the aperture edge 26. In the embodiment shown, the first light distribution 34 corresponds to a rule-consistent low beam light distribution for right hand traffic in which the cut-off line 42 on the left side is lower than on the right side, in order to avoid an otherwise possible glare of oncoming traffic.

Figure 3:
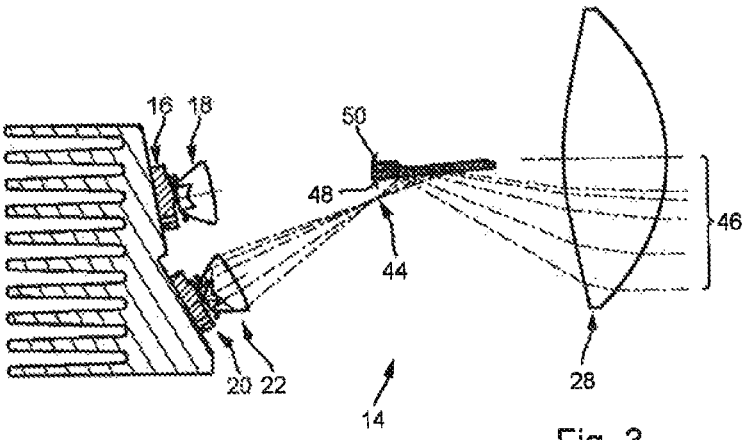
FIG. 3 illustrates elements of the subject matter of FIG. 1 in a different operating condition.

FIG. 3 shows the multi-function projection module 14 from FIG. 1 with an activated second light source 20 and an deactivated first light source 16. Because of its arrangement and dimensioning of its elements, the multi-function projection module 14 is designed to focus light of the second light source 20 via the second primary lens system into a beam waist 44, and to transfer by means of a second beam path 46 said light into a second light distribution, which is located in the front end of the projection module 14 and which comprises a predetermined central point.

Subsequently, such a second light distribution is described with reference to FIG. 4. The multi-function projection module 14 described in FIG. 3 includes a mirror 48 which is arranged in the second beam path 46 between the beam waist 44 and the projection lens 28 in such a way that it produces a virtual reflection of the beam waist 44 which is surrounding a point 50 that is associated with the central point of the second light distribution by means of an optical reproduction conveyed by the projection lens 28. In one embodiment the point 50 is the intersection point of the optical axis 12 with the curved Petzval surface 45 of the projection lens 28. The Petzval surface 45 includes points which the projection lens 28 focuses sharply on the curved image area. Usually, the Petzval surface is curved toward a vertical line V, as well as toward a horizontal line H, wherein the curvature follows the curvature of the light ingress surface of the projection lens. As a result, the central point 50 lies particularly at the distance of the focal length f of the projection lens 28 in the light path in front of the projection lens.

Figure 4:
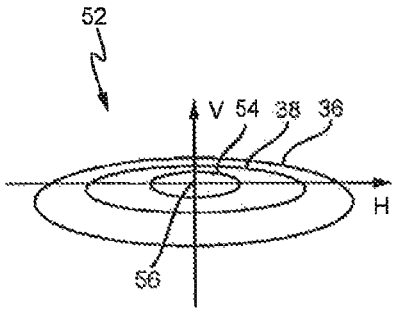
FIG. 4 is a light distribution resulting from the second operating condition.

FIG. 4 shows a second light distribution 52 of this type that appears on the screen in the front end of the headlamp 10, or in the front end of the multi-function projection module 14. Also in this case, it applies that the adjustment of the screen takes place orthogonally toward the optical axis 12 of the multi-function projection module 14, and that the screen extends in the direction of the horizontal line H and the vertical line V. As a result, the screen extends, respectively, particularly orthogonally toward the optical axis 12 of the projection module 14. At the same time, the isolux lines 36, 38 and 54 of the second light distribution represent an illuminance which increases from the outside to the inside, i.e., from isolux line 36 via isolux line 38 toward islux line 54 and, in addition, toward the center of the second light distribution 52. The second light distribution 52 includes no distinct horizontal cut-off line and therefore represents a typical high beam light distribution.

In the headlamp 10 shown in FIGS. 1 and 3, the second light distribution 52 results when only the second light source 20 is activated, or when both light sources 16 and 20 are activated. The last-mentioned alternative achieves the highest possible illuminance. Alternatively, it is possible to generate the high beam light distribution only by means of the second light source 22. In this case, the first light source 16 is switched off when the second light source 22 is switched on. In this embodiment the luminosity in the area located closer to the motor vehicle is reduced through the deactivation of the first light source 16, which directs the attention of the driver more on the areas located further in front of the motor vehicle, which are illuminated by the further reaching second beam path 46.

The second light distribution includes a central point 56. In the embodiment shown, said point 56 is located in the intersection point of the horizontal line H and the vertical line V and represents the reproduction of point 50 shown in FIG. 3 conveyed by the projection lens 28. In other words: The point 50 shown in FIG. 3 is assigned by means of an optical reproduction to the central point 56 shown in FIG. 4. The elements involved in the reproduction are arranged and dimensioned in such a way that the point 50 is reproduced in the central point 56 of the second light distribution 52 shown in FIG. 4. Since point 50 is located in the virtual reflection of the beam waist, it appears that the light projected into the central point 56 of the second light distribution 52 comes directly from point 50.

The aperture edge 26 includes the upper edge of the aperture 24 facing the primary lens system 18. The aperture edge 26 is approximately located in a Petzval surface 45 of the projection lens 28, so that the mostly horizontally extending aperture edge 26 of the cut-off line is sharply reproduced in the first light distribution 34 and thus also sharply reproduced on the road.

Preferably, both light sources 16 and 18 can be independently activated, and their light is emitted in different beam-paths 32, 46. At the same time, the first beam-path 32 as a low beam beam-path is assigned to the first light source 16 as a low beam light source, while the second beam-path 46 as a high beam beam-path is assigned to the second light source 20 as a high beam light source. The bundle of rays of the first beam-path 32 is concentrated via the first primary lens system 18, restricted by the aperture 24 and projected on the road by the projection lens 28.

The bundle of rays of the second beam-path 46 is concentrated by the second primary lens system 22 and then deflected to the projection lens 28 by means of a reflection on the mirror 48. When the headlamp is used according to its intended purpose, the mirror 48 is preferably located below the aperture edge 26 of the aperture 24. The high beam bundle of rays is then projected onto the road by the projection lens 28. The mirror 48 has been arranged in the second beam-path 46 in such a way that the virtual reflection of the beam waist 44 is approximately located in the focal point 50 of the projection lens 28. As a result, it appears that the second beam-path 46 emerges from the focal point 50, or the intersection point of the optical axis 12 with the Petzval surface 45 of the projection lens 28. This results in a high beam light distribution having a central point that is approximately located in point 50 of the second light distribution 52 (high beam light distribution).

For this purpose, the mirror 48 has to be extensively expanded from the Petzval surface 45 in the direction of the projection lens 28. At the same time, the mirror 48 extends via a Petzval surface 45 of the projection lens along a length into a space located between the Petzval surface 45 and the projection lens 28, which is greater than half f/2 of the focal length f of the projection lens 28. As a result of this defocused position, the edges of the mirror 48 are no longer sharply reproduced by the projection lens 28. This has an advantage because sharply produced edges would result in undesired contrasts in the second light distribution 52.

Contrary to the prior art of the above-mentioned US 2006/0120094, the second beam-path 46, i.e., the high beam beam-path, is not restricted by the aperture edge 26 restricting the low beam beam-path. As a result, the second light distribution 52, which, in the context of the presented subject matter, is generated from the second beam-path 46, has no sharp cut-off line, and the second light distribution also does not result from a superimposition of two-dimensional complimentary light distributions having complimentary cut-off lines.

In the presented invention, the activation taking place in addition to the already activated first light source 16 allows for a superimposition of the first light distribution 34 and the second light distribution 52 with a high beam light distribution in which through the superimposition the sharp cut-off line 42 of the first light distribution 34 overpowers, for example covers, the second light distribution 52 focusing around the central point 56. Alternatively, the high-beam light distribution can also be generated alone by means of the second light source 22. In this case, the first light source 16 is deactivated when the second light source 22 is activated.

In one embodiment, the multi-function projection module 14 includes two light sources 16, 20, which can be activated independent from one another, each of which having its own focusing primary lens system 18 (for the first light source 16) and 22 (for the second light source 20), which concentrate the light that is emitted by the assigned light source, respectively, in a Petzval surface 45 of the projection lens. The projection lens 28 projects the light distribution generated by the primary lens systems 18 and 22 in the Petzval surface into the front end of the motor vehicle headlamp 10, i.e., particularly onto the road or onto a standard measuring screen. The light sources 16, 20 are designed as individual semiconductor light sources or as semiconductor light arrays, wherein a semiconductor light array consists of a plurality of semiconductor light sources. For example, semiconductor light sources comprise luminescence diodes (LED) or laser diodes. The focusing primary lens systems 18 and 22 can be designed as reflectors or lenses. Reflectors can consist of structures with a reflective coating in which the light is propagated through air, impacts the reflective coating and from there is again propagated through air. Alternatively, the reflectors can consist of light-conducting primary lens systems in which the light is coupled into the light-conducting material of the primary lens system and there receives through the surrounding air total reflection on the boundary surfaces. Importantly, the internal total reflection results almost in no losses. In particular, this is advantageous when using semiconductor light sources for headlamp functions, because compared to gas discharge lamps, semiconductor light sources emit rather low streams of light.

It is also advantageous to use primary lens systems in which the beam-path is divided, wherein a bundle of rays is projected through a lens, and additional bundles of rays are deflected through internal total reflection on a boundary surface of the primary lens system.

Figure 5:
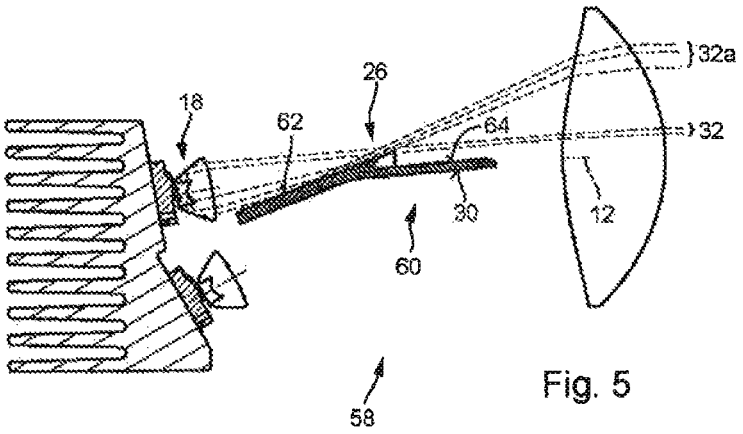
FIG. 5 illustrates elements of a second embodiment of the present invention.

FIG. 5 shows another embodiment of the invention. In particular, FIG. 2 shows a multi-function projection module 58 which differs from the multi-function projection module 14 shown in FIG. 1 in that instead of the aperture 24 of the multi-function projection module 14 a different aperture 60 is used. Incidentally, the other components of the multi-function projection module 56 correspond to the elements of the multi-function projection module 14 provided with the same reference numerals in FIG. 1. For a description of these elements, reference is made to the description above regarding FIGS. 1 and 2, especially FIG. 1.

The aperture 60 of the multi-function projection module 58 shown in FIG. 5 has been implemented in the form of a mirror shutter which extends from the aperture edge 26 into a space located between the aperture edge 26 and the first primary lens system 18. The aperture 60 comprises a mirror 62 which protrudes rigidly into the first beam-path 32 between the first primary lens system 18 and the aperture. A portion of the light propagated in the first beam-path 32 is deflected by the mirror and thus forms a further beam-path 32*a*.

At the same time, the light deflected in the further beam-path 32*a* corresponds to exactly the light that impacts the aperture 24 below the aperture edge 26, as shown by the subject matter of FIG. 1. In the subject matter of FIG. 1, said light is hidden and absorbed by the first beam-path 32. Therefore, FIG. 2 shows that it does not reach the first light distribution 34 (low beam light distribution) resulting from the first beam-path 32. In this respect, with regard to the subject matter of FIG. 1, the formation of a sharp cut-off line 42 in the first light distribution 34 is gained with a certain reduction of brightness in the light portion 40 below the cut-off line 42 of the first light distribution 34.

This disadvantage is avoided in the subject matter of FIG. 5. In the subject matter of FIG. 5 the light impacting the aperture 60 below the aperture edge 26 is not absorbed but deflected in a comparatively shallow manner into the further beam-path 32*a*. The light propagated in the further beam-path 32*a* is subsequently refracted by the projection lens 28, wherein the inclination of the mirror 62 toward the optical axis 12 is adjusted to the geometry and refractive properties of the projection lens 28 in such a way that the light propagated in the further beam path 32*a* is projected in the light portion 40 of the first light distribution 34 below the cut-off line 42. This results in an increase of illumination intensity in the light portion 40 which is especially advantageous when semiconductor light sources are used as low beam light sources. In other words: using a low beam mirror shutter 60, increases the efficiency of the multi-function projection module for the low beam. For example, the efficiency involves the light output standardized for the light output of the low beam light source by means of which the light portion 40 is illuminated.

At the same time, it appears that the efficiency increasing light beams propagated in the further beam-path 32*a* originate in an area located below the light emission surface of the first primary lens system 18. In this respect, the mirror 62 of the aperture 60 results in a virtual expansion of the light emission surface of the first primary lens system 18.

In one embodiment, the mirror 62 is designed in the form of a metallic surface and forms together with the aperture 60 an integral component. On its surface facing the beam-path 46 (high beam beam-path), the aperture 60 comprises the mirror 30 described above, which is arranged in the second beam-path 46 located between the beam waist 44 and the projection lens 28 and which generates a virtual reflection of the beam waist 44. The metallic mirror surfaces are produced by coating the respective areas of the aperture 60 with metal, particularly by vapor-coating the metal. Prior to coating the area with metal, the surface is preferably provided with a varnish which smoothes the roughness of the surface. Advantageously, both mirrors can be metalized in one operational process.

In one embodiment, the rear surface 64 of the mirror 30 located in the light path behind the aperture edge 26 and facing the first beam-path 32 comprises a light-diffusing coating and/or light-diffusing structures. As a result, it is possible to avoid disturbing light reflexes in the low beam light distribution. Such light reflexes can result when stray light penetrating the rear surface 64 of the headlamp would be projected from there through the projection lens 28 into areas of the first light distribution 34 (low beam light distribution), which are located above the cut-off line.

Alternatively, the rear surface 64 can also include a dispersive coating or dispersive structures which are purposely designed to reflect incident light of the first light source 18 on the projection lens 28 in such way that it is refracted by the projection lens 28 as defined overhead illumination into a dark portion of the first light distribution 34, i.e., into a portion of the first light distribution 34 located above the cut-off line. Such a comparatively weak illumination of specific portions above the cut-off line is in accordance with the law and has, for example, the purpose of improving the visibility of traffic signs.

The embodiments described above include a non-transparent, reflecting and/or absorbing aperture in which light propagated through air is reflected on a preferably metallic mirror surface.

Figure 6:
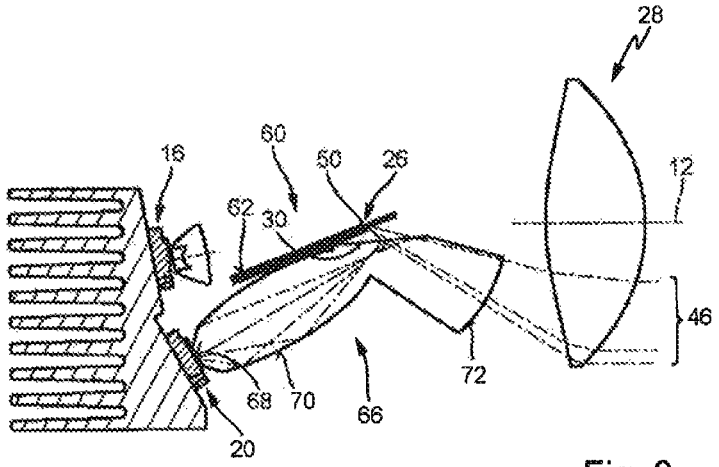
FIG. 6 illustrates a third embodiment of the present invention.

FIG. 6 shows an embodiment in which the mirror 30, which is located in the second beam-path 46 and which generates the virtual reflection of the beam waist 44 in the focal point 50 of the projection lens 28, is implemented as a boundary surface of a light conductor 66. In the embodiment shown, the light conductor 66 comprising the mirror 30 forms an integral unit with the second primary lens system 22. This has the advantage that by means of the light conductor all optically active surfaces of the light conductor 66 are solidly fixed in their position to one another. The optically active surface comprise the light ingress surface 68 facing the second light source 20, transport surfaces 70 in which the light propagated in the light conductor 66 receives internal total reflection, a light emission surface facing the projection lens 28 and the boundary surface acting a TIR mirror 30 (TIR=total internal reflection). As a result, these surfaces do not have to be adjusted toward one another when the multi-function projection module is produced.

It is also advantageous that the light conductor 66, which is bulky when compared to the primary lens systems 18 and 22, allows for the additional use of holding the aperture, by means of which the sharp cut-off line 42 is generated in the first light distribution 34, i.e., in the low beam light distribution.

In another embodiment, a boundary surface acting as TIR mirror 30 is part of a deflecting prism that differs from the primary lens system. Independent of whether the surface used as a mirror includes a metallic surface adjoining air or a TIR boundary surface, it involves a planar surface. Alternatively, it can also have a convex or concave design, and/or it can comprise straying micro-geometries.

FIG. 6 shows an embodiment in which a mirror shutter 60, which restricts the first beam-path 32, or which restricts the light emitted by the first light source 16, is mounted on the light conductor 66. Initially, the mirror shutter 60 is therefore a component that is separate from the light conductor 66.

The embodiment according to FIG. 6 involves a mirror shutter 60 with a mirror 62 such as is described in the context of FIG. 5. Instead of such a mirror shutter 60, it is also possible to use an aperture absorbing below the aperture edge 26. For this purpose, the surface of the mirror 62 of the aperture 60 can, for example, be coated with an absorbing or light-diffusing material.

Figure 7:
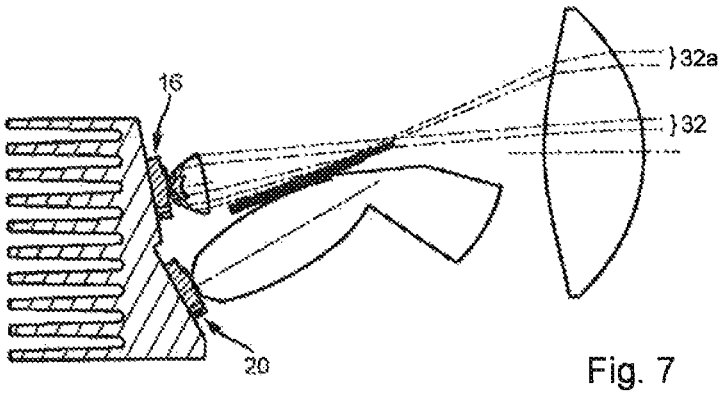
FIG. 7 illustrates the subject matter of FIG. 6 in a different operating condition.

FIG. 7 shows the subject matter of FIG. 6 when the first light source 16 is activated and the second light source 20 is deactivated. For a description of the beam-paths 32 and 32*a* reference is made to FIG. 5.

Figure 8:
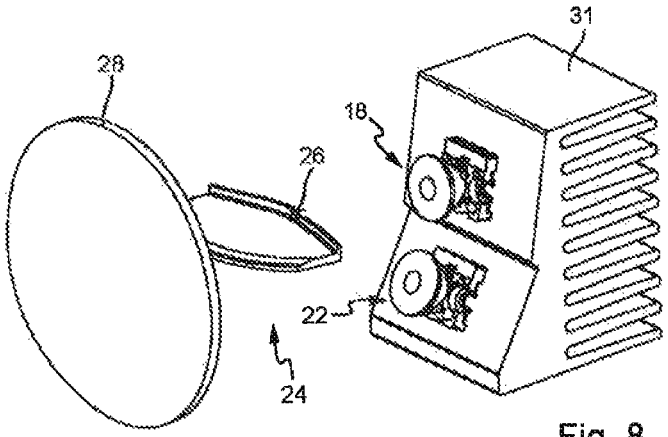
FIG. 8 is a perspective view of elements of the first embodiment.
Figure 9:
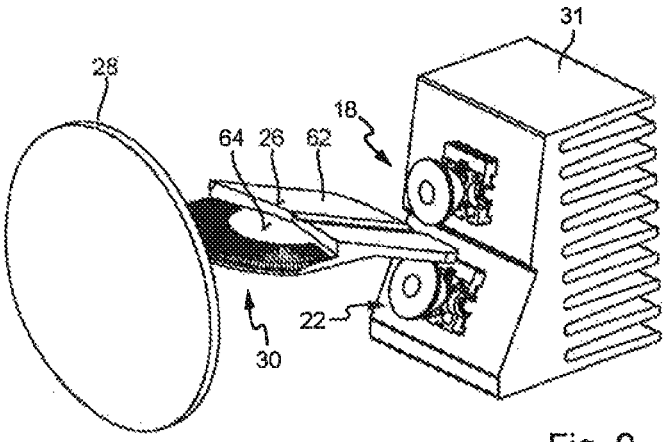
FIG. 9 is a perspective view of elements of the second embodiment.
Figure 10:
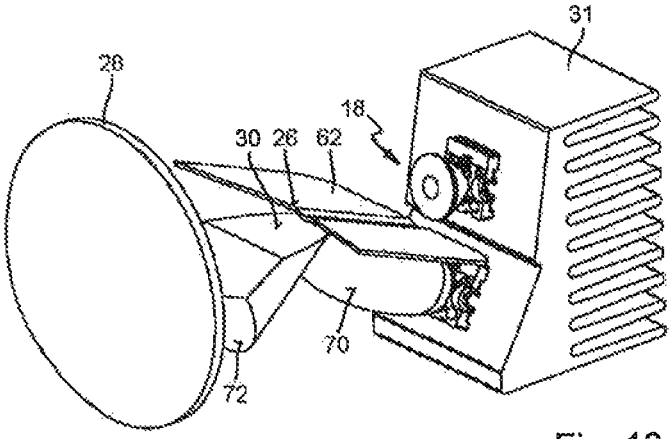
FIG. 10 is a perspective view of elements of the third embodiment.

FIGS. 8, 9 and 10, respectively, show a perspective representation of the subject matter of FIGS. 1, 5 and 6. The perspective representations should contribute to a better understanding of the respective subject matters. For example, the perspective representations show in particular that the course of the aperture edge 26 of the Petzval surface 45 follows the projection lens 28 and therefore comprises a particular curve in a horizontal plane. Furthermore, the structured rear surface 64 of the mirror 30 in FIG. 9 demonstrates the optionally available, straying structures, which have been described in the context of FIG. 5, and which have the purpose of preventing undesired reflexes and/or of generating a defined overhead illumination.

What is claimed is:

1. A motor vehicle headlamp having a multi-function projection module, said headlamp comprising:

a first light source, a first primary lens system, a second light source, a second primary lens system, an aperture having an aperture edge, a projection lens having an optical axis, and a mirror being reflective, and wherein each of the first and second light sources is oriented to face the projection lens;

the first primary lens system being configured to transfer light of the first light source in a first beam-path being restricted by the aperture edge such that the first-beam path is restricted to be above the optical axis and into a first light distribution area located in front of the projection module;

the second primary lens system being configured to focus light of the second light source in a second beam-path into a beam waist and to transfer the light into a second light distribution area located in front of the projection module;

the second light distribution area includes a predetermined central point, which when the headlamp is used according to its intended purpose, lies at an intersection point of a horizontal line H=0 and a vertical line V=0 in front of the vehicle in the manner predetermined by the lighting standards for motor vehicles; and wherein the mirror is arranged in the second beam path such that the mirror is configured to reflect the light in second beam path such that the second beam path is restricted to be below the optical axis and wherein the mirror is disposed between the beam waist and the projection lens such that the mirror is configured to generate a virtual reflection of the beam waist that surrounds the predetermined central point of the second light distribution area through an image conveyed by the projection lens.

2. The motor vehicle headlamp as set forth in claim 1 wherein the mirror extends beyond a Petzval surface of the projection lens over a particular length in a space situated between the Petzval surface and the projection lens, which length is greater than half (f/2) the focal length (f) of the projection lens.

3. The motor vehicle headlamp as set forth in claim 1 wherein when used according to its intended purpose the mirror lies below the aperture edge of the aperture.

4. The motor vehicle headlamp as set forth in claim 2 wherein the aperture edge is arranged at a distance from the projection lens corresponding to a focal length (f) of the projection lens.

5. The motor vehicle headlamp as set forth in claim 1 wherein a rear surface of the mirror comprises at least one of a light-diffusing coating, a light-diffusing structure, and a scattering structure, designed to reflect incident light of the first light source on the projection lens in such a way that it is refracted by the projection lens as defined overhead illumination into a dark portion of the first light distribution area.

6. The motor vehicle headlamp as set forth in claim 1 wherein the aperture is implemented in the form of a mirror shutter which extends starting from the aperture edge into a space situated between the aperture edge and the first primary lens system, and which is arranged to reflect incident light on the projection lens in such a way that it is refracted by the projection lens in a light portion of the first light distribution area.

7. The motor vehicle headlamp as set forth in claim 1 wherein the mirror is designed in the form of a mirrored metallic surface and forms an integrally molded component together with the aperture.

8. The motor vehicle headlamp as set forth in claim 1 wherein the mirror is a boundary surface of a light conductor.

9. The motor vehicle headlamp as set forth in claim 8 wherein the light conductor is implemented as an integral part of the second primary lens system.

10. The motor vehicle headlamp as set forth in claim 8 wherein the mirror shutter is a component that is separate from the light conductor.

11. The motor vehicle headlamp as set for in claim 2 wherein the predetermined central point of the second light distribution area is located at an intersection point of the optical axis and the Petzval surface of the projection lens.

12. A motor vehicle headlamp comprising:

a first light source, a first primary lens system, a second light source, a second primary lens system, an aperture having an aperture edge, a projection lens having an optical axis, and a mirror being reflective, and wherein each of the first and second light sources is oriented to face the projection lens;

the first primary lens system being configured to transfer light of the first light source in a first beam-path being restricted by the aperture edge such that the first-beam path is restricted to be above the optical axis;

the second primary lens system being configured to focus light of the second light source in a second beam-path into a beam waist; and;

wherein the mirror is arranged in the second beam path and is disposed between the beam waist and the projection lens and is configured to reflect the light in the second beam path such that the second beam path is restricted to be below the optical axis.

13. The motor vehicle headlamp as set for in claim 12 wherein the first light source is disposed below the optical axis.

14. The motor vehicle headlamp as set for in claim 12 wherein the second light source is disposed below the optical axis.

15. The motor vehicle headlamp as set for in claim 12 wherein the first primary lens system is disposed partially above the optical axis and partially below the optical axis.

16. The motor vehicle headlamp as set for in claim 12 wherein the second primary lens system is disposed below the optical axis.

17. The motor vehicle headlamp as set for in claim 12 wherein the first light source is mounted on a first carrier and wherein the first primary lens system is coupled to the first carrier.

18. The motor vehicle headlamp as set for in claim 12 wherein the second light source is mounted on a second carrier and wherein the second primary lens system is coupled to the second carrier.

* * * * *